United States Patent [19]

Conti

[11] 4,034,578

[45] July 12, 1977

[54] TIGHTS

[75] Inventor: Paolo Conti, Firenze, Italy

[73] Assignee: Billi S.p.A., Firenze, Italy

[21] Appl. No.: 484,465

[22] Filed: June 28, 1974

[30] Foreign Application Priority Data

July 2, 1973 Italy ..... 9527/73

[51] Int. Cl.[2] ..... D04B 9/18

[52] U.S. Cl. ..... 66/49; 66/177

[58] Field of Search ..... 66/175, 176, 177

[56] References Cited

U.S. PATENT DOCUMENTS

| | | | |
|---|---|---|---|
| 3,748,870 | 7/1973 | Fregeolle | 66/177 |
| 3,802,229 | 4/1974 | Fregeolle | 66/177 |
| Re. 27,886 | 1/1974 | Johnson | 66/177 |

OTHER PUBLICATIONS

Goadby, "Billi's Pair of One-Piece Pantie-Hose", The Hosiery Trade Journal, June 1973, vol. 80, No. 954, pp. 99 & 100.

*Primary Examiner*—Ronald Feldbaum

[57] ABSTRACT

Tights comprising a first tubular portion forming a first leg portion, a second tubular portion forming a second leg portion, and an intermediate portion between the first and second portions forming a pants portion, are produced on a circular knitting machine by knitting the first tubular portion using continuous circular motion of the needle cylinder, knitting the intermediate portion using reciprocating motion of the needle cylinder to form a rectangular opening in the intermediate portion, and knitting the second tubular portion using continuous motion of the needle cylinder.

6 Claims, 10 Drawing Figures

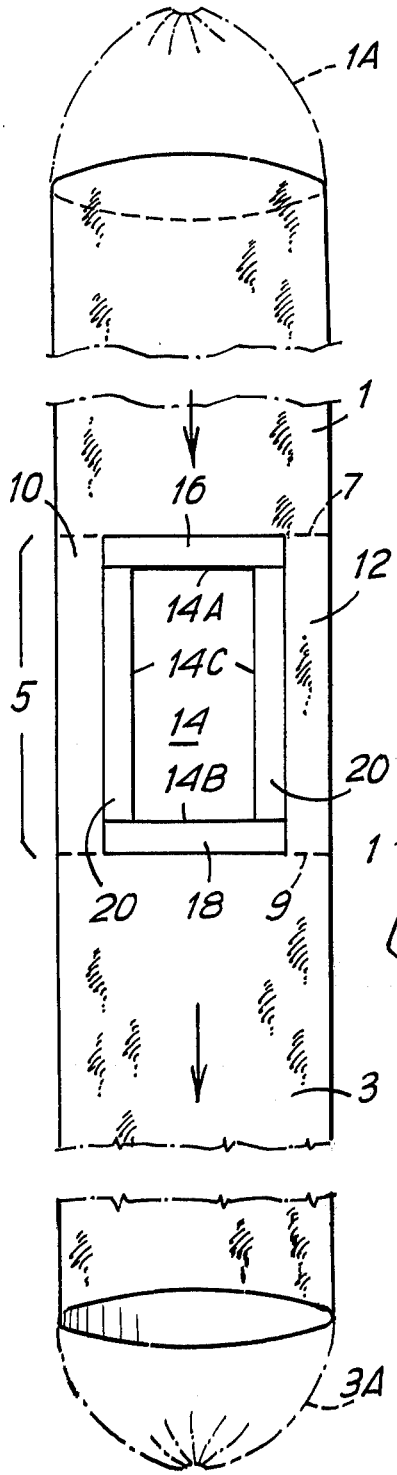
Fig.1
Fig.2
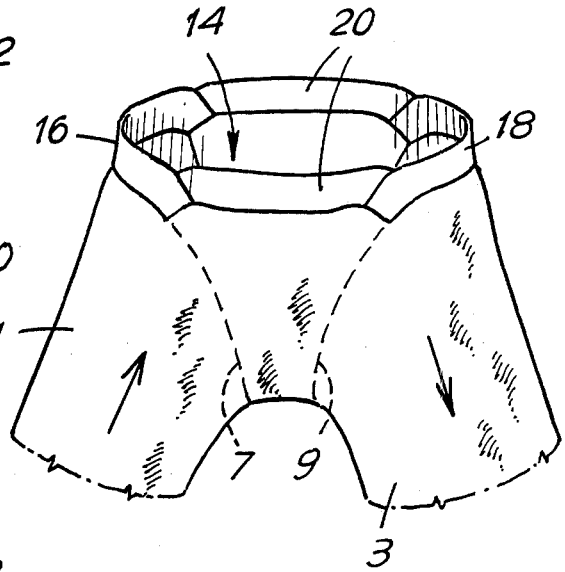

TIGHTS

BACKGROUND OF THE INVENTION

1. Field of the Invention

The present invention relates to knitted articles, and more particularly to tights.

2. Description of the Prior Art

It is known to produce tights in the form of two tubular portions, which form the respective legs, and a central portion, between the tubular portions, which forms the pants portion of the tights. The central section is provided with an opening the periphery of which defines the waist line which is at least partly bounded by elastic zones.

It has been proposed to knit these tights on a circular knitting machine using continuous rotational motion of the needle cylinder, with the opening being constituted by a longitudinal slit or by a rectangular opening or the like. It has also been proposed to knit these tights using continuous motion of the needle cylinder when knitting the two tubular leg portions, and using a reciprocating motion of the cylinder when knitting the central portion, the opening, in this case, being in the form of a longitudinal slit. These previously proposed methods lead to certain drawbacks regarding the time required for the production of the relatively long portion in which the slit is developed, and defects arising in the slit zone which defines the waist line, owing to the non-satisfactory adaptation to the body shape — when the article is worn — and to non-satisfactory operation of the elastic zones.

SUMMARY OF THE INVENTION

According to the present invention, there is provided a process for knitting, on a circular knitting machine having a needle cylinder, tights comprising a tubular element including a central zone arranged to form the pants portion of the tights and having a rectangular opening whose periphery defines the waist line of the tights, said periphery being bounded, at least partly, by an elastic zone, said process comprising knitting, by means of reciprocating motion at the needle cylinder, a transverse band of elastic fabric at each longitudinal end of the opening, forming adjacent each of said transverse bands of elastic fabric, transverse edges of the rectangular opening by abandoning a needle arc and resuming work by said needle arc, knitting, by means of reciprocating motion of the needle cylinder, longitudinal bands of elastic using two independent elastic yarns, said longitudinal bands lying along the longitudinal edges of the opening, the residual fabric in correspondence of the rectangular opening zone being constituted by at least two fabric portions defined by courses of stitches formed by adjacent arcs of needles with different yarn feeds, the needle arcs including at their ends at least one needle common with the adjacent arcs whereby at least one stitch is formed with the yarns fed to the two adjacent arcs, and the needle cylinder being actuated with alternate angular strokes having an amplitude slightly higher than the larger of said arcs.

Further according to the present invention, there is provided a process for knitting, on a circular knitting machine having a needle cylinder, tights comprising a first tubular portion forming a first leg portion, a second tubular portion forming a second leg portion, and an intermediate portion between the first and second portions forming a pants portion, said process comprising the steps of knitting the first tubular portion using continuous circular motion of the needle cylinder, knitting the intermediate portion using reciprocating motion of the needle cylinder to form a rectangular opening in the intermediate portion, and knitting the second tubular portion using continuous motion of the needle cylinder.

Double tubular sheath flaps can be formed along the transverse edges of the opening in a manner similar to the so-called "Scott & Williams" type double welt, formed using hooks carried by a welt dial or the like.

BRIEF DESCRIPTION OF THE DRAWINGS

The invention will now be described, by way of example only, with reference to the accompanying diagrammatic drawings, in which:

FIG. 1 is a developed view of tights in accordance with the present invention, the tights being knitted on a circular knitting machine;

FIG. 2 is an elevation showing the tights when being worn;

DESCRIPTION OF THE PREFERRED EMBODIMENT

Figure 4:
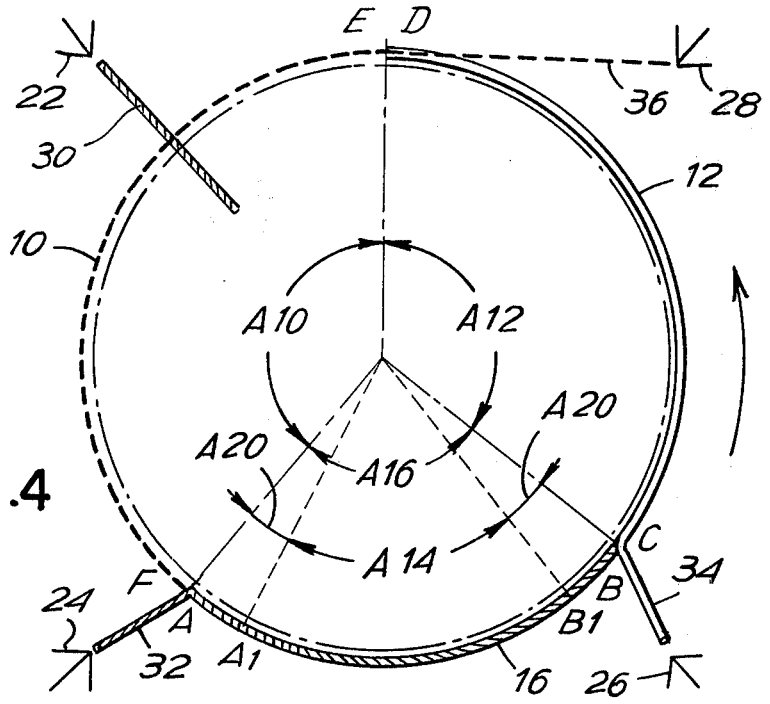
FIGS. 4 and 5, and 6 and 7 respectively, are schematic views showing the needle cylinder of the machine in two end positions respectively adjacent to, and in correspondence of, the opening.
Figure 3:
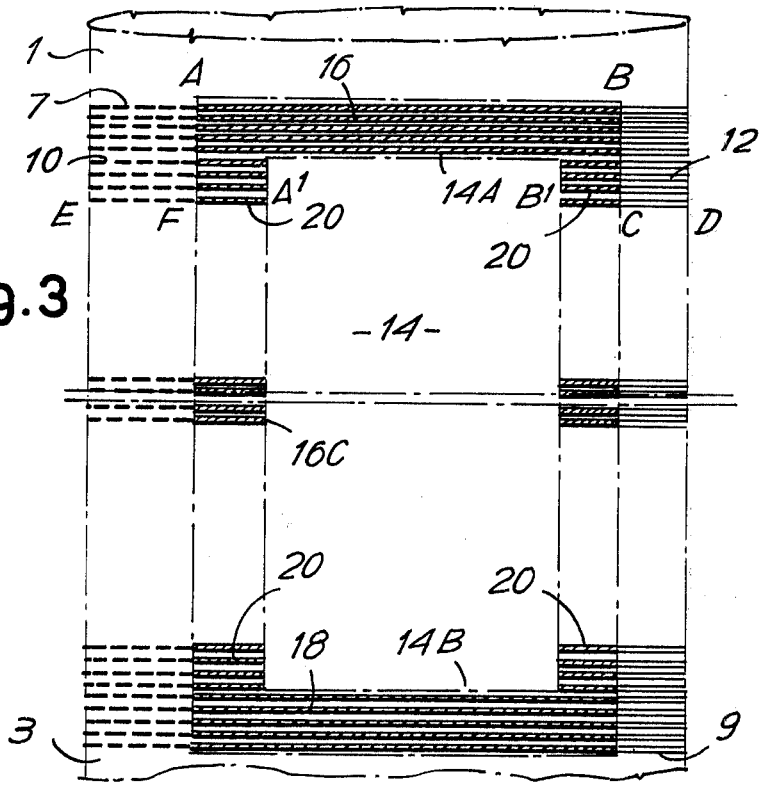
FIG. 3 is a developed view of a rectangular opening of the tights.

There is shown in FIG. 1, a knitted article in the form of tights comprising two outer tubular portions 1 and 3 knitted on a circular knitting machine with continuous circular motion of the needle cylinder. The tubular portions 1 and 3 constitute the respective legs of the tights and have closed ends 1A and 3A for the tips of the feet, the closed ends being formed on the knitting machine in a manner known per se. The portion 1 is knitted before the portion 3 and is spaced therefrom by means of an intermediate or central zone 5 of the article, which zone is defined between a circumferential line 7 at the end of the portion 1 and a circumferential line 9 at the end of the portion 3. The intermediate zone 5 comprises fabric portions 10 and 12 which may at least partly be formed as a continuation of the fabric of the portions 1, 3. The portions 10, 12 can be formed with thicker stitches and with other means provided by varying the needle selection, for forming the crutch zone and to facilitate the shaping of the pants portion of the article when the article is being worn (see FIG. 2).

The zone 5 has a rectangular opening 14 having two transverse edges 14A and 14B and two longitudinal edges 14C. Two transverse bands 16 and 18 of elastic fabric are adjacent the ends of the opening 14 defined by the edges 14A and 14B; the elastic band 16 lies between the edges 14A and the line 7, and the band 18 lies between the edge 14B and the line 9. The longitudinal edges 14C are flanked by longitudinal elastic bands 20. The bands 16, 18 and 20 collectively form a waist band of the pants portion of the article.

The article is formed in the zone 5 by reciprocating motion, i.e., by alternating motion of the needle cylinder with the use of a certain number of yarn feeds. The alternating movements of the needle cylinder are of relatively restricted amplitude, in such a manner that with each of the yarn feeds, that is with each of the yarns, fabric zones are formed along correspondingly proportioned needle arcs.

In FIGS. 3 to 7, there is shown schematically a process for forming the zone 5 with four yarn feeds. The portions 1 and 3 can be formed with a different number of feeds, although some of the feeds in this case can be the same as those used to form the zone 5.

More particularly there are provided four feeds 22, 24, 26 and 28. The feeds 22 and 24 supply an elastic yarn 30 and 32 respectively and the two feeds 26 and 28 supply a yarn 34 and 36 respectively having reduced elastic characteristics, for example a yarn of the type generally known under the name of "filanca" or the like. The yarn 34 and 36 can be of the same type as that used to form the portions 1 and 3, or can be of a different type or count; more particularly, the yarns 34 and 36 can be the same or similar to the yarns which form the parts of the portions 1 and 3 adjacent the lines 7 and 9 whereby the pants portion is formed with a fabric different from that used to form the main parts of the leg portions or the peripheral parts of the leg portions.

The needles of the needle cylinder are preferably divided into three arcs A10, A12, and A16; the arcs can also be defined by the angles subtended thereto. The needle arc A16 is subtended between points A and B and corresponds to the zone in which the bands 16 and 18 are developed; the arcs A10 and A12 are subtended between points E and F, and between points C and d respectively, and correspond to the fabric of the portions 10 and 12. The arc A16 may for instance include 120 needles and the arcs A10, A12, 156 needles each, plus one or more needles in common with the adjacent arcs. The arc A16 is divided into an intermediate arc A14 and into two end arcs A20 which correspond respectively to the opening 14 and to the bands 20.

Figure 8:
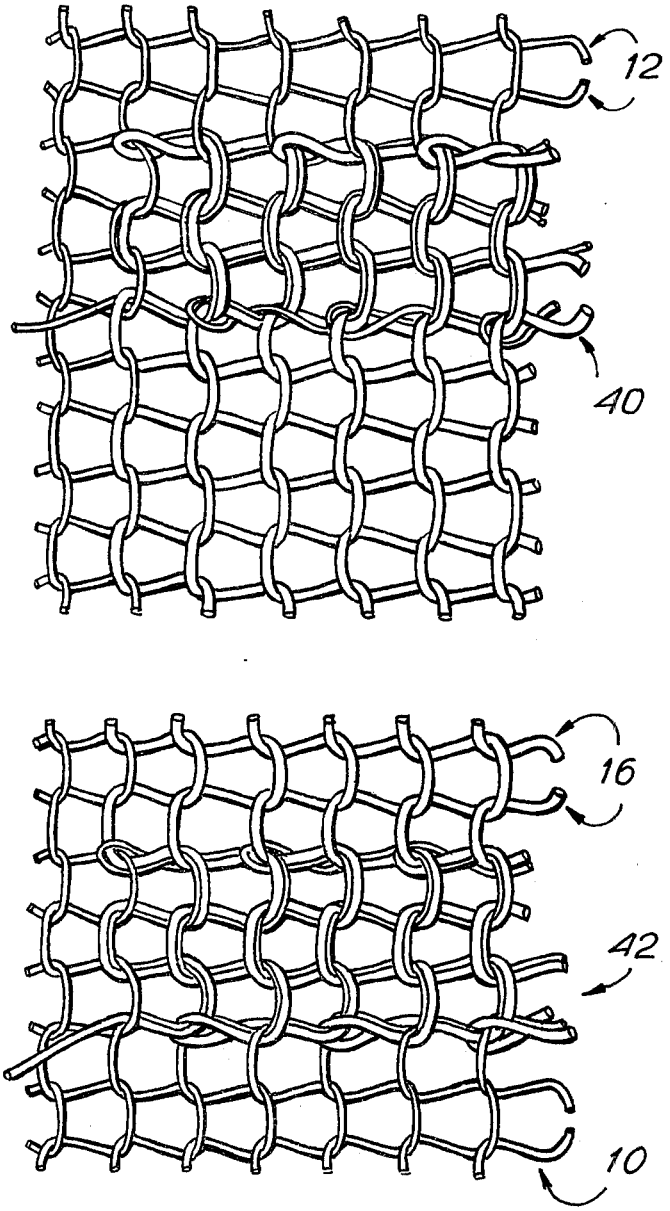
FIG. 8 shows various connection zones of the knitted fabric.
Figure 9:
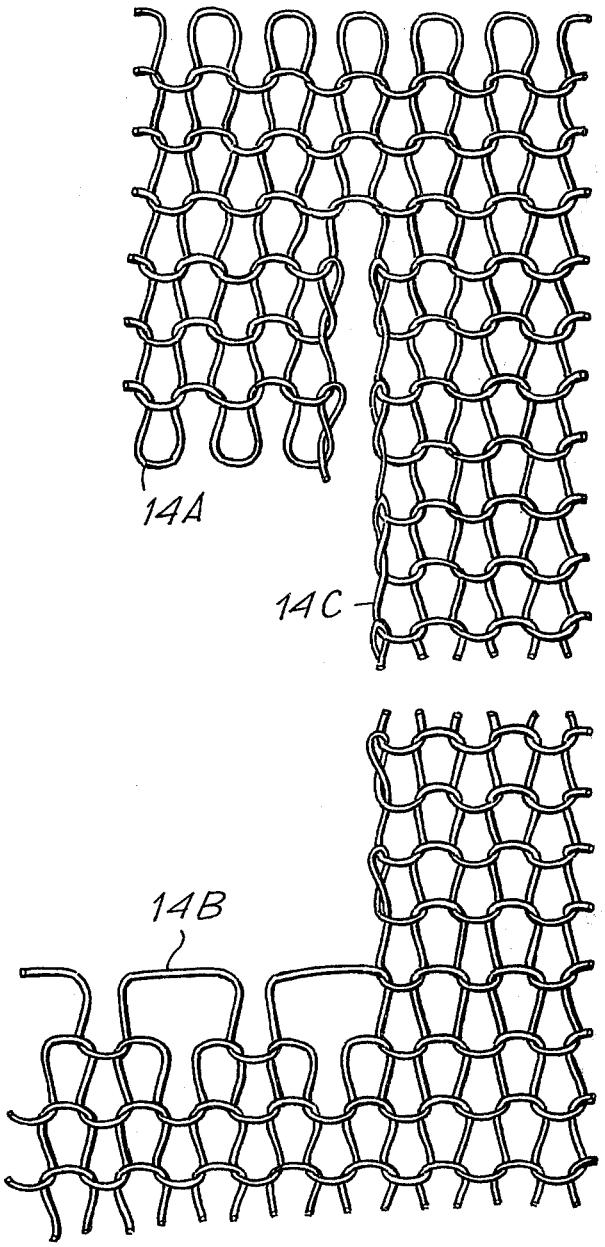
FIG. 9 shows the fabric in the zone of the rectangular opening.

During the formation of the band 16 (and correspondingly during the formation of the band 18) the reciprocating motion of the needle cylinder, over an angular amplitude of about 180°, effects formation of the fabric portions 10 and 12 with the yarns 36 and 34 respectively, and formation of the band 16 with one of the two elastic yarns 30 and 32, which is taken up by each of the needles of the arc A16 whereby to form elastic yarn stitches, (see also FIG. 8 where the stitches are indicated by a thicker line). The second yarn is inserted immediately before beginning the formation of the edge 20.

Figure 5:
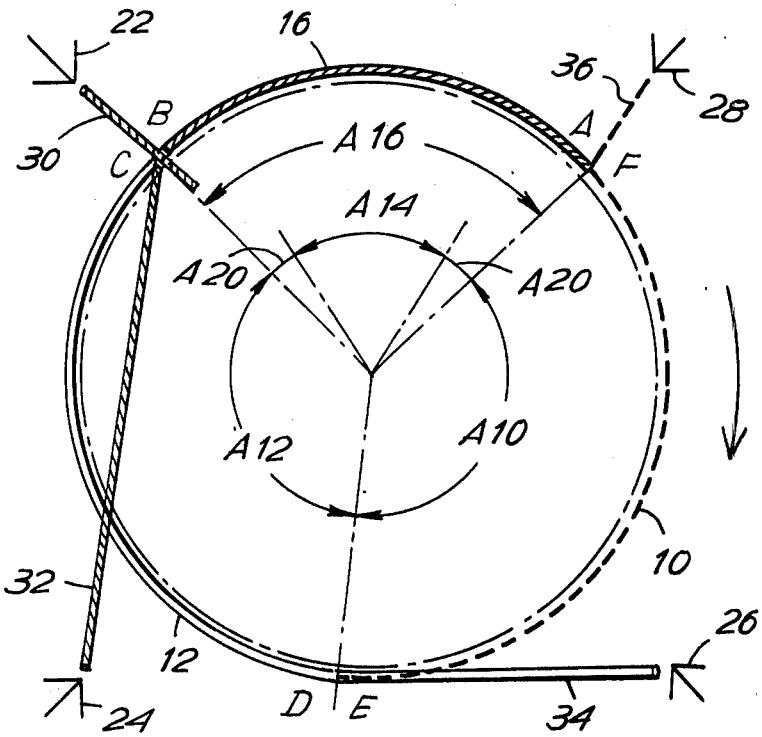
Figure 6:
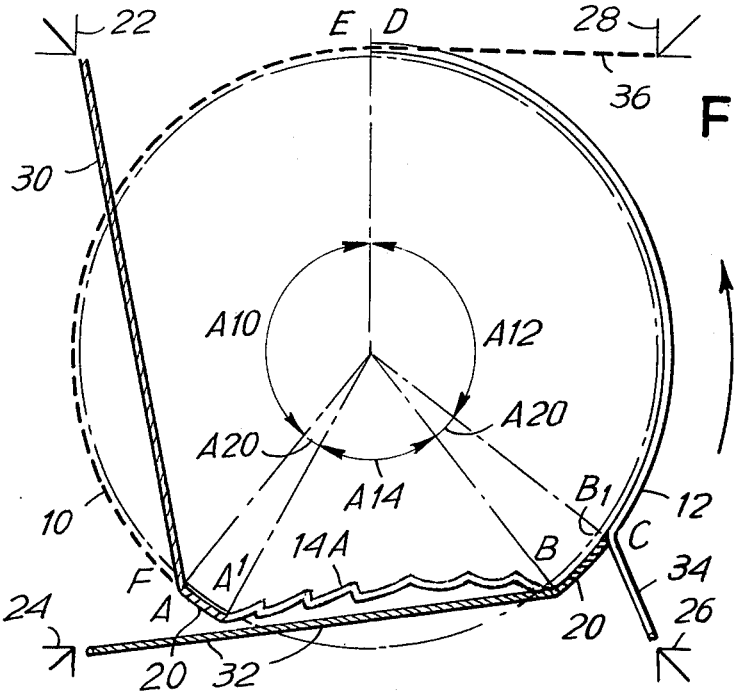
Figure 7:
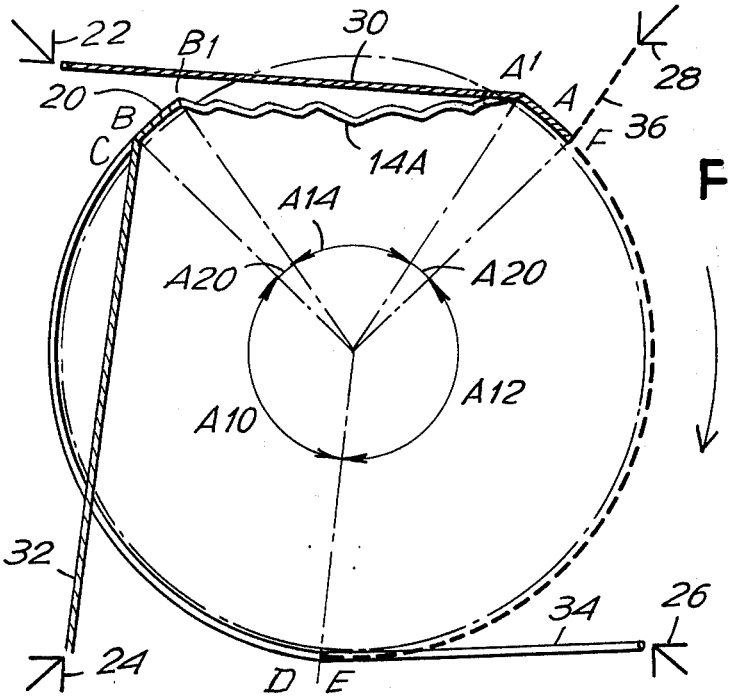

The needles of the arcs are selected by conventional means so as to be raised during movement into the positions in which the respective yarns are to be engaged by the needles. FIGS. 4 and 5 illustrate two end positions of the needle cylinder, that is at the moment of the reversal of the needle cylinder with the arrays of the different yarns. Some of the needles at the ends of the arcs A10, A12, A16 are common to the adjacent arcs so that the respective fabric portions are interconnected by stitches formed by the yarns associated with both arcs.

When the band 16 has been formed, the needles along arc A14 between the points A1 and B1 are operated to abandon or cast-off the fabric whereby to form the edge 14A; moreover, the needles along arcs A20 between the points A, A1 and B, B1 are operated so that the needles of the arcs A, A1 only take the elastic yarn 30 and those along the other arc B, B1 only take the yarn 32; the selection conditions at the arcs A10 and A12 in relation to the yarns 34 and 36 remain unaltered. Thus there are formed together with the portions 10 and 12, the band 20 which trim the longitudinal edges 14C of the opening 14. Thses edges 14C are defined by stitches formed in correspondence of the reversal of the distribution of the yarns, these edges thus being devoid of sheared yarns and thus being well finished.

When the bands 20 have been completed, the needles along the arc A14 are again inserted to form the edge 14B in a sinilar manner to that described above, and all the needles along the arc A16 are operated in the same manner as that during the formation of the transverse band 16, whereby to form the transverse band 18.

When the ban 18 has been completed, the portion 3 is formed using continuous motion of the needle cylinder.

The continuous motion can be interrupted along the line 7 and be re-assumed beyond the line 9.

During the reciprocating motion, the several fabric zones 10, 12 and 16, 20, 18 are connected with one another — although being formed by different yarns — by virtue of the fact that, as already stated, some end needles along the arcs A10, A12, A16 are common to the adjacent arcs and thus connection stitches are formed by the yarns of adjacent arcs, as indicated for example by stitches 40 and 42 in FIG. 8.

Figure 10:
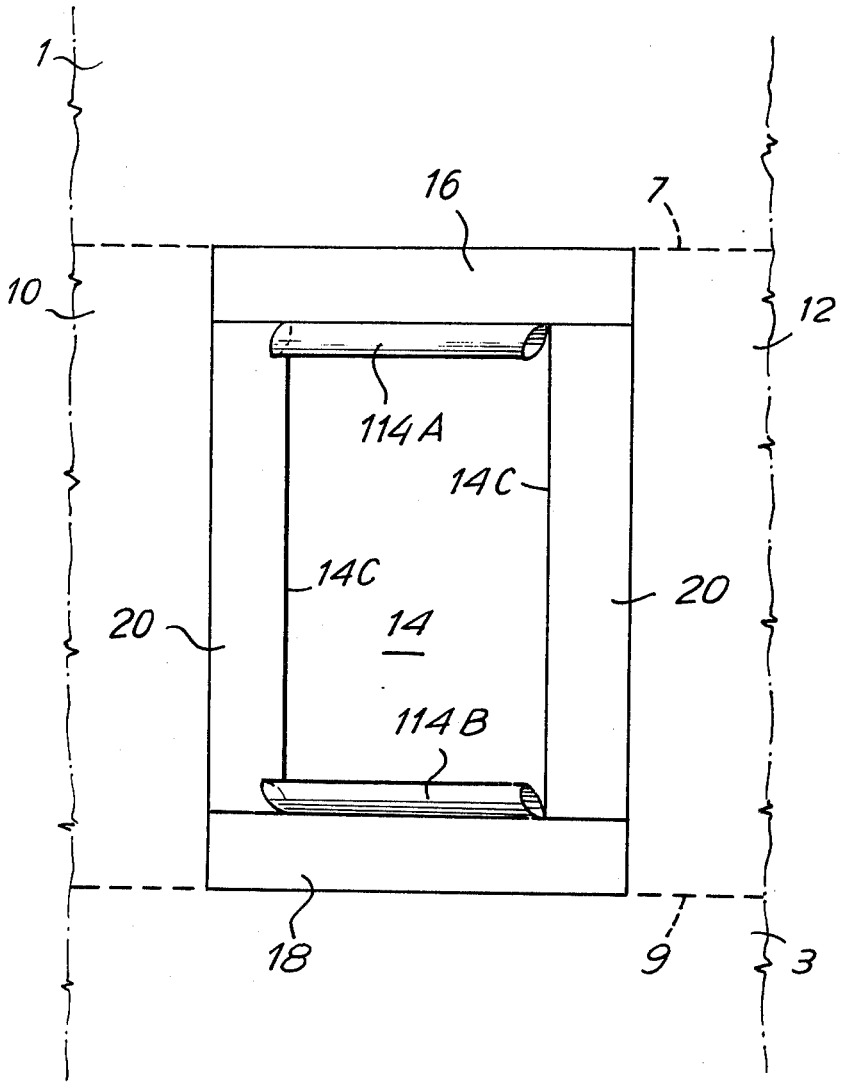
FIG. 10 shows a modified form of fabric structure in the zone of the rectangular opening.

In the modified form of article shown in FIG. 10 the transverse edges 14A and 14B are formed with tubular sheaths 114A and 114B, respectively by means of the automatic double welt technique.

The knitted article obtained by means of the process described has a good finish along the longitudinal edges 14C, with respect to the finish obtained by using continuous motion of the needle cylinder and shearing the yarns of the single courses. The quantity of elastic yarn used is less than that used by comparable previously proposed processes. Also the process described is quicker than a process using a reciprocating motion of the needle cylinder for the major portion of the article.

What is claimed is:

1. A process for knitting, on a circular knitting machine having a needle cylinder, tights comprising a tubular element including a central zone arranged to form the pants portion of the tights and having a rectangular opening whose periphery defines the waist line of the tights, said periphery being bounded, at least partly, by an elastic zone, said process comprising forming by means of reciprocating motion of the needle cylinder, a transverse band of elastic fabric at each longitudinal end of the said rectangular opening, forming, adjacent each of said transverse bands of elastic fabric, transverse edges of the rectangular opening by abandoning a first needle arc and resuming work by said first needle arc, forming, by means of said reciprocating motion of the needle cylinder, longitudinal bands of elastic using two independent elastic yarns, and with the needles of two second arcs of needles of small width adjacent said first arc of the needles, said longitudinal bands lying along the longitudinal edges of the opening, the residual fabric in correspondence of the rectangular opening zone being constituted by at least two fabric portions defined by courses of stitches formed by further adjacent arcs of needles with different yarn feeds, said second arcs of needles and said further needle arcs including at their ends at least one needle common with the continuous arcs whereby at least one stitch is formed with the yarns fed to the two contiguous arcs, and the needle cylinder being actuated with alternate angular strokes having an amplitude slightly higher than the larger of said arcs.

2. A process according to claim 1, wherein at each longitudinal end of the opening a transverse band of elastic fabric is formed by an elastic yarn, two yarns being fed so as to be taken up separately by the needles of two relatively short arcs adjacent the arc of excluded needles to obtain the transverse dimension of the rectangular opening, said relatively short arcs forming the longitudinal bands.

3. A process according to claim 1, wherein the yarn is supplied, during the reciprocating motion of the needle cylinder, by four spaced yarn feeds, two adjacent said feeds supplying elastic yarns.

4. A process according to claim 1, wherein tubular double flaps are formed along the transverse edges of the rectangular opening.

5. A process for knitting, on a circular knitting machine having a needle cylinder, tights comprising a tubular element including a central zone arranged to form the pants portion of the tights and having a rectangular opening whose periphery defines the waist line of the tights, said periphery being bounded, at least partly, by an elastic zone, said process comprising forming a transverse band of elastic fabric at each longitudinal end of the opening, forming, adjacent each of said transverse bands of elastic fabric, transverse edges of the rectangular opening by abandoning a first needle arc and resuming work by said first needle arc, knitting, by means of reciprocating motion of the needle cylinder, longitudinal bands of elastic using two independent elastic yarns, and with the needles of two second arcs of needles of small width adjacent said first arc of needles, said longitudinal bands lying along the longitudinal edges of the opening, the residual fabric in correspondence with the rectangular opening zone comprising courses of stitches formed by at least one further arc of needles, said second arcs of needles and said further needle arcs including at their ends at least one needle common with the contiguous arcs whereby at least one stitch is formed with the yarns fed to the contiguous arcs, and the needle cylinder being actuated with alternate angular strokes having an amplitude slightly higher than the larger of said arcs.

6. A process according to claim 5, wherein said residual fabric in correspondence with the rectangular opening zone comprises at least two fabric portions defined by courses of stitches formed by further adjacent arcs of needles with different yarn feeds.

* * * * *